United States Patent [19]

Mohn

[11] Patent Number: 4,830,584

[45] Date of Patent: May 16, 1989

[54] PUMP OR COMPRESSOR UNIT

[76] Inventor: Frank Mohn, 110 Coombe Lane, London, England, SW20 0Ay

[21] Appl. No.: 939,517

[22] PCT Filed: Mar. 18, 1986

[86] PCT No.: PCT/GB86/00156

§ 371 Date: Jan. 20, 1987

§ 102(e) Date: Jan. 20, 1987

[87] PCT Pub. No.: WO86/05557

PCT Pub. Date: Sep. 25, 1986

[30] Foreign Application Priority Data

Mar. 19, 1985 [GB] United Kingdom ..... 8507010

[51] Int. Cl.[4] ..... F04B 15/02

[52] U.S. Cl. ..... 417/356; 417/430; 415/143; 415/182.1; 415/62

[58] Field of Search ..... 415/66, 68, 69, 77, 415/79, 62, 143, 182, 183, 208, 216, 199.5; 417/244, 356, 430; 366/262

[56] References Cited

U.S. PATENT DOCUMENTS

| | | | |
|---|---|---|---|
| 7,857 | 12/1850 | Mayfield | 417/430 |
| 762,808 | 6/1904 | Cushing et al. | 417/430 X |
| 980,644 | 1/1911 | Knight | 419/65 |
| 2,234,733 | 3/1941 | Jendrassik | 415/65 |
| 2,406,959 | 9/1946 | Millard | 417/356 |
| 2,500,400 | 3/1950 | Cogswell | 417/356 X |
| 2,537,310 | 1/1951 | Lapp | 417/356 |
| 2,697,986 | 12/1954 | Meagher | 417/356 |
| 4,449,888 | 5/1984 | Balje | 415/62 X |
| 4,523,896 | 6/1985 | Lhenry et al. | 417/244 |
| 4,541,782 | 9/1985 | Mohn | 417/244 |

FOREIGN PATENT DOCUMENTS

| | | | |
|---|---|---|---|
| 0445941 | 11/1970 | Australia . | |
| 1394237 | 5/1975 | United Kingdom | 417/430 |

*Primary Examiner*—Carlton R. Croyle
*Assistant Examiner*—Eugene L. Szczecina, Jr.
*Attorney, Agent, or Firm*—Young & Thompson

[57] ABSTRACT

A pump or compressor unit (1) suited particularly for mixed phase fluids, e.g. mixed gas and oil, has a multi-stage axial flow compressor device with contra-rotating vanes. An upstream mixer device (10) and a downstream centrifugal impeller device (32) can each be driven by the compressor device (21, 26, 27, 29), which may be shaped to provide a flow passage of decreasing cross-section in the flow direction. The compressor drives may be supplied by axially adjacent electric motors (24, 25) which may surround rotating sleeves (21) carrying the compressor vanes. A fluid can be circulated through the unit, e.g. for electrical insulation, and may be leaked into the pump fluid through seals, when it may contain a corrosion inhibiting agent. The unit may be arranged to be movable along a pipeline under fluid pressure to engage power supply contacts at a predetermined location.

13 Claims, 3 Drawing Sheets

FIG. 2.
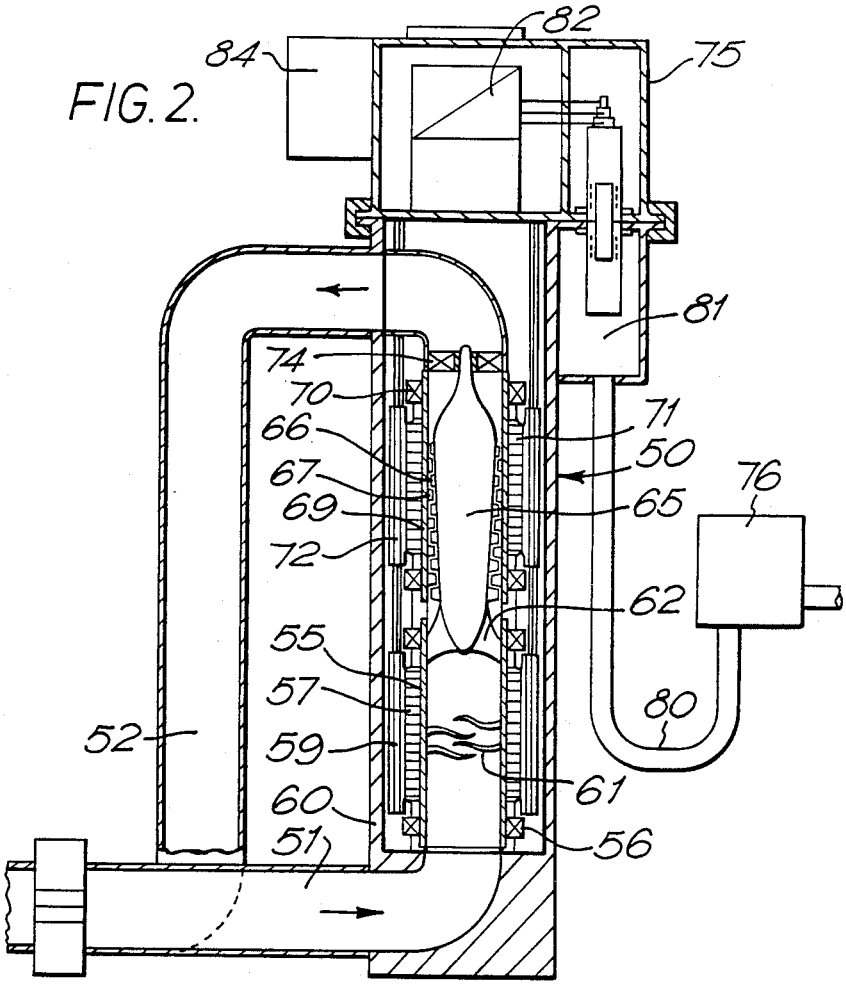
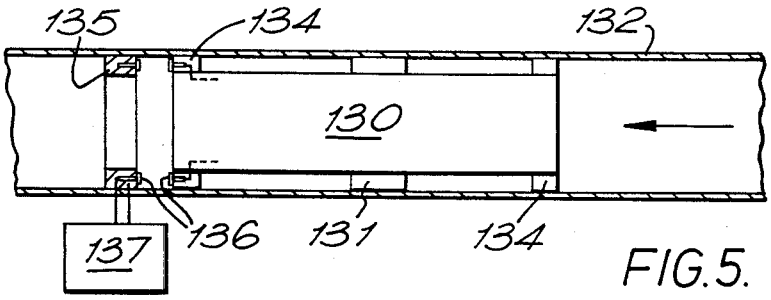
FIG. 5.

PUMP OR COMPRESSOR UNIT

The invention relates to a pump or compressor unit.

In the extraction of oil from offshore sites, problems arise from the presence in the extracted oil of substantial quantities of gas. The extracted oil releases gas as a consequence of the decrease of pressure it experiences on extraction, so what is obtained is a plural or multiphase fluid flow comprising a very non-homogenous mixture of oil and gas. Sometimes substantial slugs of oil without a substantial admixture of gas are encountered and the impact of these can be sufficient to cause damage to equipment. It is consequently desirable to effect separation of the gas from the oil as early as possible in the extraction process and thus the mixture may be first supplied to an offshore platform at which this separation is effected, the oil and gas being supplied from the platform, for example to shore, through separate pipelines.

The presence of gas admixed with the extracted oil thus causes serious complications in the handling of the extracted material and the invention is concerned with the provision of a pump/compressor unit which can be employed to alleviate them.

The invention accordingly provides a pump/compressor unit including a multi-stage axial flow compressor device, preferably contra-rotating. A rotating element of the device can carry one or more upstream vanes, co-operable with stationary vanes. A mixer device can be positioned at the inlet end of the pump-/compressor unit and this device can be an active mixer device which can take its drive from the compressor device. The mixer device can be specially profiled, for example, as an inducer, to have appropriate capability for handling gas and/or liquid slugs. The effect of the compressor device and/or the mixer in homogenising a mixed phase fluid is such that the unit can include a centrifugal pump device downstream of the compressor device. The centrifugal impeller may also take its drive from the compressor device.

The invention thus also provides a pump/compressor unit for a liquid/gas mixture, the unit having an upstream mixer device and downstream compressor means. The compressor means can comprise successive stages which can be located so as to operate within a progressively more restricted cross-sectional flow area, as by mounting one set of blades on a support between blades mounted within a preferably contra-rotating sleeve or tube the support being frusto-conical and/or the sleeve being internally frusto-conical. The invention thus provides for increasing the pressure of the fluid by small predetermined increments, so that a homogenising effect is obtained, in contrast to the tendency of conventional centrifugal pumps to promote separation of the components of a gas/liquid mixture.

The invention can conveniently be embodied in the form of adjacent axially aligned independently rotatable sleeves for reception in a pipe-line, the upstream sleeve containing one or more mixing elements at the upstream end and at least one first compressor stage at its downstream end which is drivingly connected with second compressor vanes located within the downstream sleeve for co-operation with third compressor vanes carried therein.

The sleeves are arranged to be rotated about their common axis, conveniently by separate electric motors. The motors may be received between each sleeve and an outer casing in which the sleeves are journalled, but the separate motors can be located within the sleeves if preferred, inside central hubs carrying the vanes and/or mixing elements. Alternatively, the motors can be spaced axially from the sleeves and connected to them by aligned shafts, or by a hollow shaft and a second shaft within it.

The electric motors can be a.c. or d.c. and can be arranged to rotate at the same speed or at different speeds, which can be selectively variable if desired. Such arrangements allow contra-rotation to be effected without the use of gears but, if preferred, a single motor can be employed, the contra-rotation and any desired speed differential being obtained by suitable gearing.

Preferably, the pump unit of the invention incorporates means for the circulation through it of a liquid which may be dielectric liquid for insulation of the electrical conductors of the unit and/or a lubricant for lubrication of its bearings. A predetermined leakage from the motor side of the unit into the pumped fluid may be provided for example by way of labyrinth seals, possibly in combination with mechanical seals, again for motor cooling and for lubrication of bearings and/or the seals. The liquid leaked in this way can be an oil or an oil product or could comprise a corrosion inhibitor, or a medium for preventing or opposing hydrate formation in the pipeline, e.g. diesel oil, glycol or methanol. Such a liquid could be supplied to the pipeline directly through a nozzle provided for the purpose instead of or in addition to the controlled leakage path, in place of a separate injection system. The circulating liquid may also be employed for cooling the motor or motors and-/or as a medium for monitoring the performance of the unit.

Although not so limited in its uses, a pump/compressor unit embodying the invention is particularly suitable for use at an undersea extraction station and if appropriate at one or more positions along a pipe line leading from such a station. The or each unit operates on the raw mixture of oil and gas directly after extraction, so as to provide a relatively homogenous mixture which can be safely and conveniently conveyed from the station for example to an offshore platform for separation. However, the improvement obtained in the characteristics of the extracted mixture can in some circumstances make it unnecessary to effect early separation, so the mixture can be carried directly to shore with a great consequential saving in equipment.

The invention is further explained below, by way of example, with reference to the accompanying drawings, in which:

FIG. 2 is a like view of a second pump or compressor unit embodying the invention, together with ancillary equipment;

FIG. 5 is a highly schematic representation of a pump or compressor unit embodying the invention, which is selectively movable within a pipeline.

Figure 1:
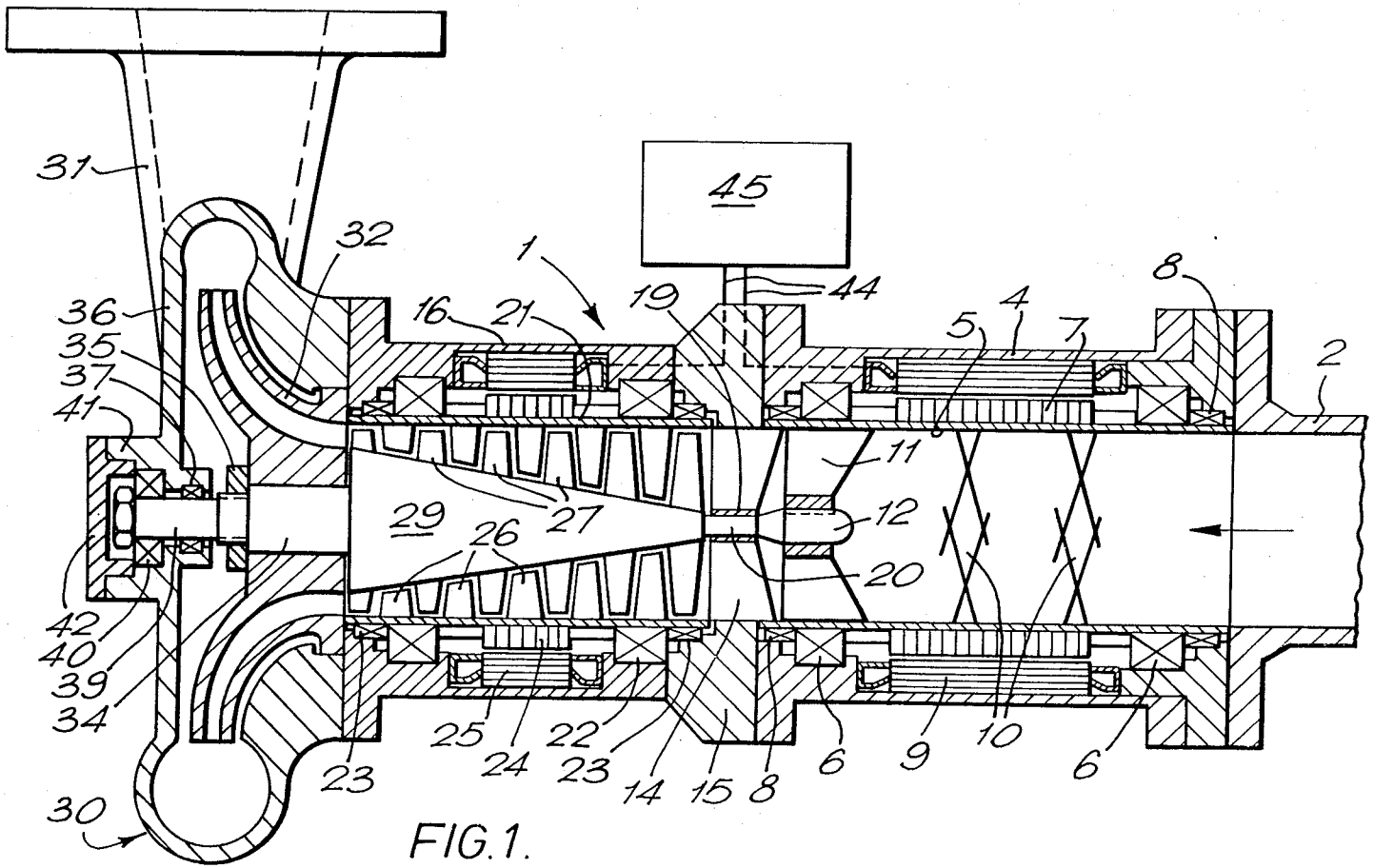
FIG. 1 is a schematic transverse cross-sectional view of a first pump or compressor unit embodying the invention.

The pump or compressor unit 1 illustrated in FIG. 1 is received in a pipe line 2 through which is being conducted a mixture of oil and gas.

The unit 1 has an upstream portion comprising an outer pipe 4 within which a mixer/compressor sleeve 5 is concentrically journalled by bearings 6. The sleeve 5 has secured around its outer surface the rotor 7 of an electric motor, and is sealed to the pipe 4 by seals 8. The rotor 7 is concentrically surrounded by the stator 9 of the motor which is mounted internally of the outer pipe 4.

In its center and upstream regions, the sleeve 5 internally mounts mixer elements 10 which are shaped and positioned to effect a more uniform admixture of the incoming mixture of gas and oil. At its downstream end the sleeve 5 has secured therein impeller means in the form of compressor blades or vanes 11 extending from the inner surface of the tube to an axial hub 12. The vanes 11 co-operate with immediately adjacent downstream stationary vanes 14 mounted within a connector ring 15 which connects the downstream end of the pipe 4 to the upstream end of a second outer pipe 16. The fixed vanes 14 extend inwardly from the ring 15 to a sleeve 19 through which a downstream shaft extension portion 20 of the hub 12 extends.

A compressor sleeve 21 is concentrically journalled by bearings 22 within the second outer pipe 16 and is sealed to the pipe by seals 23. As with the upstream mixer/compressor tube 5, the sleeve 21 carries externally the rotor portion 24 of an electric motor which is again concentrically surrounded by a stator portion 25 fixed within the outer pipe 16.

Internally, the downstream compressor sleeve 21 carries a plurality of axially spaced compressor blades or vanes 26 each received between an adjacent pair of compressor blades or vanes 27 carried on a frusto-conical support 29 to constitute a multistage axial flow compressor device. The support 29 extends downstream from the shaft extension portion and enlarges in cross-section in the downstream direction in frusto-conical manner. The vanes 26 and 27 are so dimensioned as to induce a pressure gradient in the mixture undergoing compression which increases in the radially outward direction.

Although the unit 1 as so far described, given only a suitable bearing for the downstream end of the support 29, will function satisfactorily, it is possible to include also a downstream centrifugal impeller device.

Thus, at the downstream end, the outer pipe 16 is flanged for securement to a centrifugal impeller casing 30 having an outlet portion 31 for connection into the pipeline 2. The outlet portion 31 could be axially directed instead of radially, as shown. A centrifugal impeller 32 within the casing 30 is retained on a reduced diameter extension portion 34 of the support 29 by means of a lock nut 35, the annular inlet of the impeller 32 registering with the annular gap between the downstream end of the support 29 and the sleeve 21. The casing 30 has an end wall 36 having a central aperture provided with a seal 37 through which extends a stub shaft 39 axially protruding from the extension portion 34. A bearing 40 for the stub shaft 39 is received within a bearing box 41 formed externally of the wall 36 and closed by a cover 42.

Power is supplied to the stator portions 9 and 25 of the two electric motors by lines 44 from control apparatus and a power source 45. The speeds at which the motors drive the sleeves 5 and 21 to rotate in opposed directions can be the same or different and can be selectively variable, either together or independently.

The pump or compressor unit 50 shown in FIG. 2 is located in a pipe system having a suction pipe 51 and a discharge pipe 52. The unit 50 resembles that of FIG. 1 in having a mixture/compressor sleeve 55 journalled in bearings 56 and having externally secured around it the rotor portion 57 of an electric motor of which the surrounding stator portion 59 is carried within an outer pipe or pump casing 60 to which the sleeve 55 is appropriately sealed. The sleeve 55 also mounts within it active mixer elements 61 and one or more compressor vanes 62.

The vanes 62 extend between the tube 55 and one end of a cylindrical blade or vane support 65. The support 65 mounts axially spaced vanes 66 on a portion thereof projecting axially in the downstream direction outwardly from the sleeve 55 for co-operation with vanes 67 carried internally of a second sleeve 69. The sleeve 69 is in axial alignment with the tube 55 and is journalled in bearings 70. Seals (not shown) are provided between the sleeve 69 and the casing 60. Carried externally of the sleeve 69 is the rotor portion 71 of an electric motor of which the stator portion 72 is secured within the casing 60. At its downstream end to support 65 tapers inwardly to a cylindrical end portion journalled in bearings 74.

At the downstream end, the pump casing 60 has secured thereto an extension casing 75 containing electrical control equipment for the unit 50 and means for the circulation of an insulating or other dielectric fluid through the unit and in the extension casing.

Electric power and pressurised dielectric oil is supplied to the casing 75 from a supply housing 76, suitably by means of a pipe 80 having received therein, with spacing, a conductor tube comprising three concentric tubular conductors with insulation between them. The spacing between the conductors and the outer pipe, and the interior of the conductor tube constitute supply and return paths for the dielectric oil. For further particulars of this and alternative oil-insulated electrical supply arrangements reference may be made to EP-A-0 No. 063 444. The pipe 80 extends to a connector chamber 81 and the conductors of the conductor tube are connected to electric frequency and power control equipment 82 from which electrical power conductors extend to the stators 59 and 72. The circulation path for the dielectric oil incorporates the interior of the pump casing 60 so the oil provides insulation for the stators and also lubrication for the bearings 56 and 70. A chamber 84 contains cooling and filtering equipment for treating the circulated dielectric oil, which can be used to monitor the performance and condition of the motors, as by measuring the temperature of the returned fluid and by monitoring the impurities it contains, as well as for cooling and lubrication.

The seals between the casing 60 and the sleeves 55 and 69 can be such as to provide for a predetermined leakage of the dielectric oil into the flow path through the interior of the unit, to promote cooling and lubrication of the seals. A corrosion resistant medium can be leaked into the flow path through such sealing arrangements and/or through a special nozzle, in addition if desired to the dielectric oil circulation arrangements.

As with the pump unit 1, the control equipment 82 allows the tubes 55 and 69 to be rotated by the electric motors at selected speeds and/or directions.

The arrangements of FIG. 2 for the circulation and/or leakage of dielectric or other fluid can of course be applied likewise to the unit 1 of FIG. 1 as well as to the units of FIGS. 3 and 4, described below and the units of FIGS. 2, 3 and 4 can incorporate downstream centrifugal impeller devices, for example, as described in connection with FIG. 1, if desired.

Figure 3:
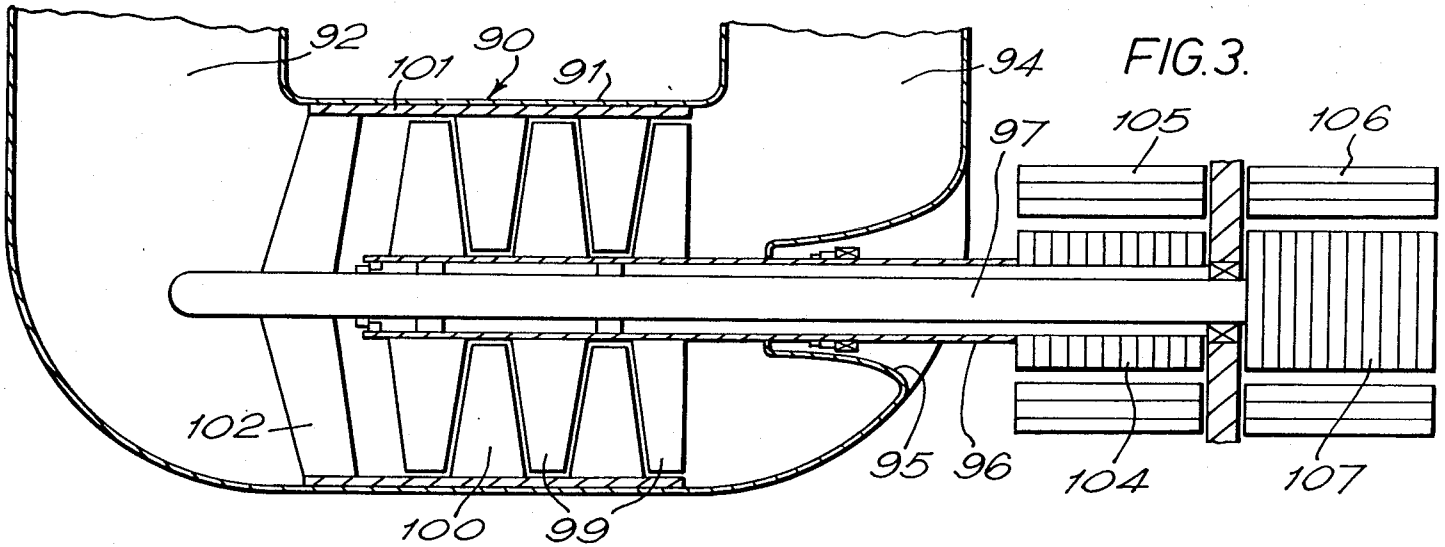
FIGS. 3 and 4 are like views of a third and fourth pump or compressor units embodying the invention.
Figure 4:
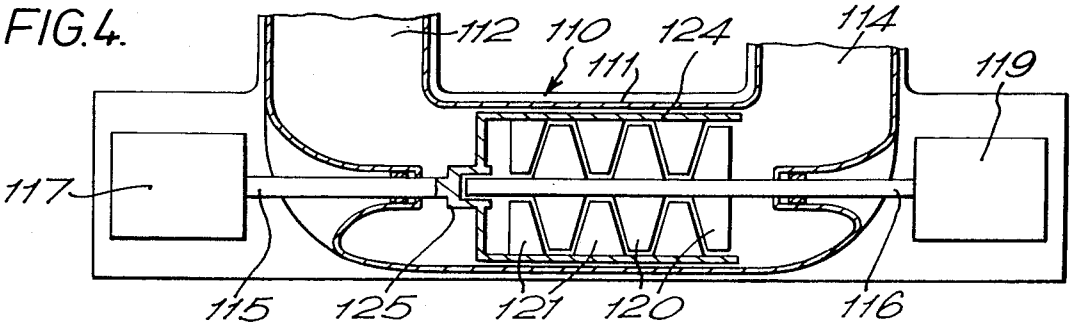

Although the contra-rotating vanes of the units 1 and 50 have been accommodated actually within the motors by which they are rotated, the invention can be embodied in other configurations, as shown in FIGS. 3 and 4.

In the pump or compressor unit 90 of FIG. 3, a pump casing 91 communicating at its ends with suction and discharge pipes 92 and 94. The latter is formed at its junction with the casing 91 with a generally bell-shaped recess 95 within which is sealingly journalled a hollow shaft 76 having a shaft 97 concentrically journalled within it. Within the pump casing, the sleeve 97 carries externally blades or vanes 99 co-operating with blades or vanes 100 carried internally of a concentric outer sleeve 101. The sleeve 101 is journalled within the casing 91 and is secured by a spider 102, shaped to function as an impeller or an active mixer, to an end of the shaft 97 projecting beyond the hollow shaft 96.

Outwardly of discharge pipe 94, the hollow shaft 96 carries the rotor portion 104 of an electric motor having a concentric stator portion 105, and the shaft 97 projects outwardly of the hollow shaft, beyond the rotor portion 104, to the rotor 106 of a second electric motor having a stator portion 107. In the pump or compressor unit 100 of FIG. 4, the physical arrangement of pump casing 111 and suction and discharge pipes 112 and 114 resembles that of the unit 90. Axially aligned shafts 115 and 116 are however sealingly journalled through respective recesses at the join of the pipes 112 and 114 to the casing from external respective electric motors 117 and 119. Blades or vanes 120 on the shaft 116 which, like the shaft 96 and the support 65, may be tapered in a way similar to that of the support 29, co-operate with blades or vanes 121 extending inwardly from a sleeve 124. The sleeve 124 is journalled within the casing 111 and secured to the shaft 115 in a way similar to the way in which the sleeve 101 in FIG. 3 is connected to the shaft 97. The end of the shaft 116 is however journalled in a fitting 125 at the end of the shaft 115.

Both pump units 90 and 110 can be operated, by control of the electric motors, in the same way as the units 1 and 50.

The pump or compressor units so far described have been shown in a static location in a pipeline, but a modified form of such a unit can be arranged to be moved to and removed from a predetermined location in a fluid pipe line at which the unit is required to operate. The compressor unit can be introduced into the fluid pipeline at deck level of a platform by way of a sluice-system and then pumped down to the required location, or through a conventional subsea pig-launcher system.

As indicated schematically in FIG. 5, a pump/compressor unit 130 is provided externally with a piston element 131 making a sliding seal with the inner surface of a pipeline 132 and with guide elements 134 making a low friction contact with the inner surface. The unit 130 may resemble the unit 1 of FIG. 1 with an axially directed centrifugal impeller outlet, or with the impeller omitted. Fluid pressure, whether of the material being conveyed or for example water which is subsequently exhausted from the pipeline, acts on the unit 130 to carry it along the pipeline to a location at which a stop in the form of an annular flange 135 is engaged by the leading end of the unit. The opposed portions of the flange and the unit carry exposed conductors 136 which engage, or respective units which become inductively coupled together, when the flange and the unit comes into abutment so that electrical communication is established, inductively and/or conductively, between the unit and a power source or power and control unit 137 which may correspond generally to the power source 45.

It will be evident that the invention can be embodied in a variety of ways other than as specifically described, whilst providing a degree of homogenisation of an oil/-gas mixture by which transportation of the mixture is considerably facilitated.

I claim:

1. In a fluid extraction system extracting a non-homogeneous mixture of gas and oil, a pump/compressor unit comprising:

an impeller sleeve, a first plurality of impeller blades extending inwardly from said sleeve, and spaced apart axially thereof, a shaft, mounting means mounting said sleeve and said shaft with said shaft extending axially of sid sleeve with spacing therefrom to define a space therebetween, a second plurality of impeller blades spaced apart axially of said shaft and extending outwardly therefrom in alternation with said impeller blades of said first plurality, drive means for rotatably driving at least one of said sleeve and said shaft about the axis of said sleeve, inlet and outlet means for conveying said mixture respectively into and out of the space between said sleeve and said shaft, at least one of said sleeve and said shaft being shaped so that the cross-sectional area of said space decreases in the direction from said inlet to said outlet means, and a mixer sleeve, mixer elements projecting inwardly from said mixer sleeve, means mounting said mixer sleeve upstream of said impeller sleeve for rotation coaxially of said impeller sleeve, and a drive motor for causing said axial rotation.

2. The system of claim 1 wherein said drive means is adapted to drive both said impeller sleeve and said shaft, said sleeve and said shaft being driven by said drive means to rotate in contrary directions.

3. The system of claim 1 wherein said shaft is of frusto-conical configuration to effect said decrease in the cross-sectional area of said space.

4. The system of claim 1 further comprising mixer means located upstream of said pump/compressor unit to promote mixing of said gas and oil prior to entry thereof into said space.

5. The system of claim 4 further comprising active mixer means located upstream of said pump/compressor unit, and means whereby said active mixer means is driven by said drive means to co-rotate with one of said shaft and said impeller sleeve.

6. The system of claim 1 wherein said drive means rotatably drives said impeller sleeve, and further comprising means drivingly coupling said mixer sleeve with said shaft.

7. The system of claim 6 further comprising a centrifugal impeller device located downstream of said pump-/compressor unit and including a rotatable impeller, and means drivingly coupling said impeller sleeve with said rotatable impeller to effect rotation thereof.

8. The system of claim 6 wherein said means coupling said mixer sleeve with said shaft comprise a portion of said shaft protruding into said mixer sleeve and upstream impeller vane means extending between said shaft portion and said second sleeve.

9. The system of claim 8 further comprising a bearing for said shaft between said sleeves, and stationary vane means extending between said bearing and said mounting means for cooperation with said upstream impeller vane means.

10. The system of claim 1 wherein each of said drive means and said drive motor comprises an electric rotor means carried externally by said sleeve and electric stator means fixedly mounted to extend around said rotor means for driving cooperation therewith.

11. The system of claim 1 further comprising pump-/compressor vanes mounted in said mixer sleeve downstream of said mixer elements.

12. The system of claim 9 further comprising fixed vane means mounted between said mixer and said impeller sleeves.

13. The system of claim 1 wherein said drive means comprises electrical drive means, and further comprising a pipeline along which said unit is adapted to be moved under fluid pressure, first electrical connector means fixedly located within said pipeline, a power supply extending to said first connector means, and second electrical connector means carried by said unit and connected to said drive means for supplying power thereto, whereby said unit can be moved along said pipeline under fluid pressure to effect connection between said first and second connector means for supply of power from said supply to said drive means.

* * * * *